United States Patent [19]

Jackman et al.

[11] 4,371,763

[45] Feb. 1, 1983

[54] INERITA SWITCH DEVICE

[75] Inventors: Peter R. Jackman, Basingstoke; David W. Crick, Addlestone, both of United Kingdom

[73] Assignee: First Inertia Switch Limited, England

[21] Appl. No.: 243,911

[22] PCT Filed: Jul. 10, 1980

[86] PCT No.: PCT/GB80/00117

§ 371 Date: Mar. 13, 1981

§ 102(e) Date: Feb. 23, 1981

[87] PCT Pub. No.: WO81/00325

PCT Pub. Date: Feb. 5, 1981

[30] Foreign Application Priority Data

Jul. 13, 1979 [GB] United Kingdom ..... 7924490

[51] Int. Cl.[3] ..... H01H 35/02

[52] U.S. Cl. ..... 200/61.45 R; 200/61.45 M; 200/61.52

[58] Field of Search ..... 200/61.45 R, 61.45 M, 200/61.46, 61.47, 61.48, 61.49, 61.50, 61.51, 61.52, 61.53, 61.54, 61.55, 61.56, 61.57, 61.58 R, 61.58 B, 61.59, DIG. 29; 340/669; 307/121; 180/282, 283, 284, 285

[56] References Cited

U.S. PATENT DOCUMENTS 2,206,067 7/1940 Waltamath ..... 200/52 R

FOREIGN PATENT DOCUMENTS 538187 7/1973 Switzerland .

WO7900500 8/1979 PCT Int'l Appl. .

*Primary Examiner*—A. T. Grimley

*Assistant Examiner*—Morris Ginsburg

*Attorney, Agent, or Firm*—Keil & Witherspoon

[57] ABSTRACT

The inertia switch device (1) comprises an inertia mass (6) which is movable from a rest position when the device is subjected to an applied acceleration or deceleration in a horizontal plane, a first electrical contact (5) movable between a first stable position in which it engages a second electrical contact (3) and a second stable position in which it no longer engages the second electrical contact, and support means (4) having a bifurcated portion (24) for carrying a bifurcated portion of the first electrical contact (5). An operating means (27) is struck by the inertia mass (6), when the applied acceleration or deceleration exceeds a threshold value and moves the first electrical contact (5) from the first to the second stable position. The operating means (27) has a first limb (31) which is struck by the inertia mass and a second limb (28) with a bifurcated portion which is pivotally mounted on the support means. A resilient biassing means (34) lies within the bifurcated portions and connects the first electrical contact (5) and the second limb (28) so as to bias the first electrical contact (5) towards the first or second stable position. A resetting means has an operating member (35) movable to operate the resilient biassing means (34) and thereby return the first electrical contact (5) to its original stable position.

17 Claims, 8 Drawing Figures

INERITA SWITCH DEVICE

TECHNICAL FIELD OF THE INVENTION

This invention relates to an inertia switch device for opening or closing electrical contacts in response to movement of the device.

BACKGROUND ART

Devices of this kind are known in which an inertia mass held in an operative position by a spring or a magnet is freed by an acceleration or a deceleration of a predetermined intensity to effect the opening or closing of the electrical contacts. Such devices are usually mounted in a vehicle in a position such that they respond to acceleration or deceleration in a horizontal direction, so that if the vehicle is subject to an impact from the front, the side, or the rear, the electrical contacts are operated. It is a disadvantage of such devices that they may not be capable of being easily reset to their original, unoperated, condition.

An object of this invention is to provide an inertia switch device which mitigates this disadvantage.

DISCLOSURE OF THE INVENTION

According to one aspect of the present invention an inertia switch device comprises an inertia mass which is movable from a rest position when the device is subjected to an applied acceleration or deceleration in a horizontal plane, a first electrical contact movable between a first stable position in which it engages a second electrical contact and a second stable position in which it no longer engages the second electrical contact, support means having a bifurcated portion for carrying a bifurcated portion of the first electrical contact, operating means engageable by the inertia mass on movement of the inertia mass as a result of the applied acceleration or deceleration exceeding a threshold value, to move the first electrical contact from the first to the second stable position, or vice versa, the operating means comprising a first limb which is struck by the inertia mass when the threshold value is exceeded and a second limb having a bifurcated portion which is pivotally mounted on the support means, resilient biassing means which lie within the bifurcated portions and connect the first electrical contact and the second limb so as to bias the first electrical contact towards the first or second stable position depending on the position of the second limb, and resetting means comprising an operating member movable to operate the resilient biassing means and thereby return the first electrical contact to its original stable position.

Conveniently the operating member may be arranged to actuate a linkage which bears against the resilient biassing means to return the first electrical contact to its original stable position.

Preferably the operating member is arranged to actuate a cranked lever which bears against the resilient biassing means to return the first electrical contact to its original stable position.

The resilient biassing means may comprise a helical tension spring hooked at opposite ends into respective holes in the first electrical contact and the second limb of the operating means.

The inertia mass, the electrical contacts, the operating means and the resilient biassing means may be accommodated in a housing and the operating member may extend out of the housing by an amount which provides a visual indication as to whether or not the operating means have been struck by the inertia mass.

It is also a disadvantage of some inertia switch devices that they do not necessarily respond and operate the electrical contacts if the device is subjected to a rotary motion such as that occurring when the vehicle rolls about its longitudinal axis.

Furthermore, where such devices are designed to operate the electrical contacts in response to rotary motion of the vehicle, this may be accompanied by a tendency to operate the electrical contacts in response to a relatively low force applied in a vertical direction. This is disadvantageous in that the device may respond to forces applied in a vertical direction such as are caused by bumps in a road along which the vehicle is travelling.

According to another aspect of the present invention an inertia switch device comprises an inertia mass which is movable from a rest position when the device is subjected to an applied acceleration or deceleration in a horizontal plane, electrical contacts operable by the inertia mass on movement of the inertia mass as a result of the applied acceleration or deceleration in said horizontal plane exceeding a predetermined value, and a second inertia mass which tends to maintain an initial rest position when the device is subjected to an applied angular rotation about an axis substantially parallel to said horizontal plane and which is also arranged to operate the electrical contacts when the applied angular rotation exceeds a predetermined value.

The inertia switch device of the invention has the advantage that the operation of the electrical contacts occurs when the angular rotation exceeds the predetermined value such as occurs when the vehicle rolls about its longitudinal axis.

The second inertia mass may be slidably mounted to produce operation of the electrical contacts when the device is subjected to said applied angular rotation. Conveniently, the second inertia mass may comprise a block slidably mounted within a compartment and arranged to resist operation of the electrical contacts by a force applied in a direction normal to the horizontal plane by peg in the compartment engaging a slot provided in the block or by a peg on the block engaging a slot provided in the compartment.

The slot may have an inverted U-shape and the peg may be arranged to engage the slot at a position at the apex of the inverted U-shape and to move along one of the arms of the slot depending on the direction of the angular rotation of the device.

The inertia switch device of the invention therefore has the additional advantage that it will resist operation of the electrical contacts by forces applied in a direction normal to the horizontal plane such as are caused by bumps in a road along which the vehicle is travelling.

Alternatively, the second inertia mass may be pivotally mounted to produce operation of the electrical contacts when the device is subjected to said applied angular rotation.

Suitably, the second inertia mass may comprise a block pivotally mounted so as to resist operation by a force applied in a direction normal to the horizontal plane.

The pivotally mounted block may be hemi-cylindrical and the operation of the electrical contacts may be produced by a cam follower arranged to co-operate with a cam rotationally fast with the pivotally mounted block.

Embodiments of the invention in both its aspects are hereinafter described, by way of example, with reference to the accompanying drawings.

Figure 1:
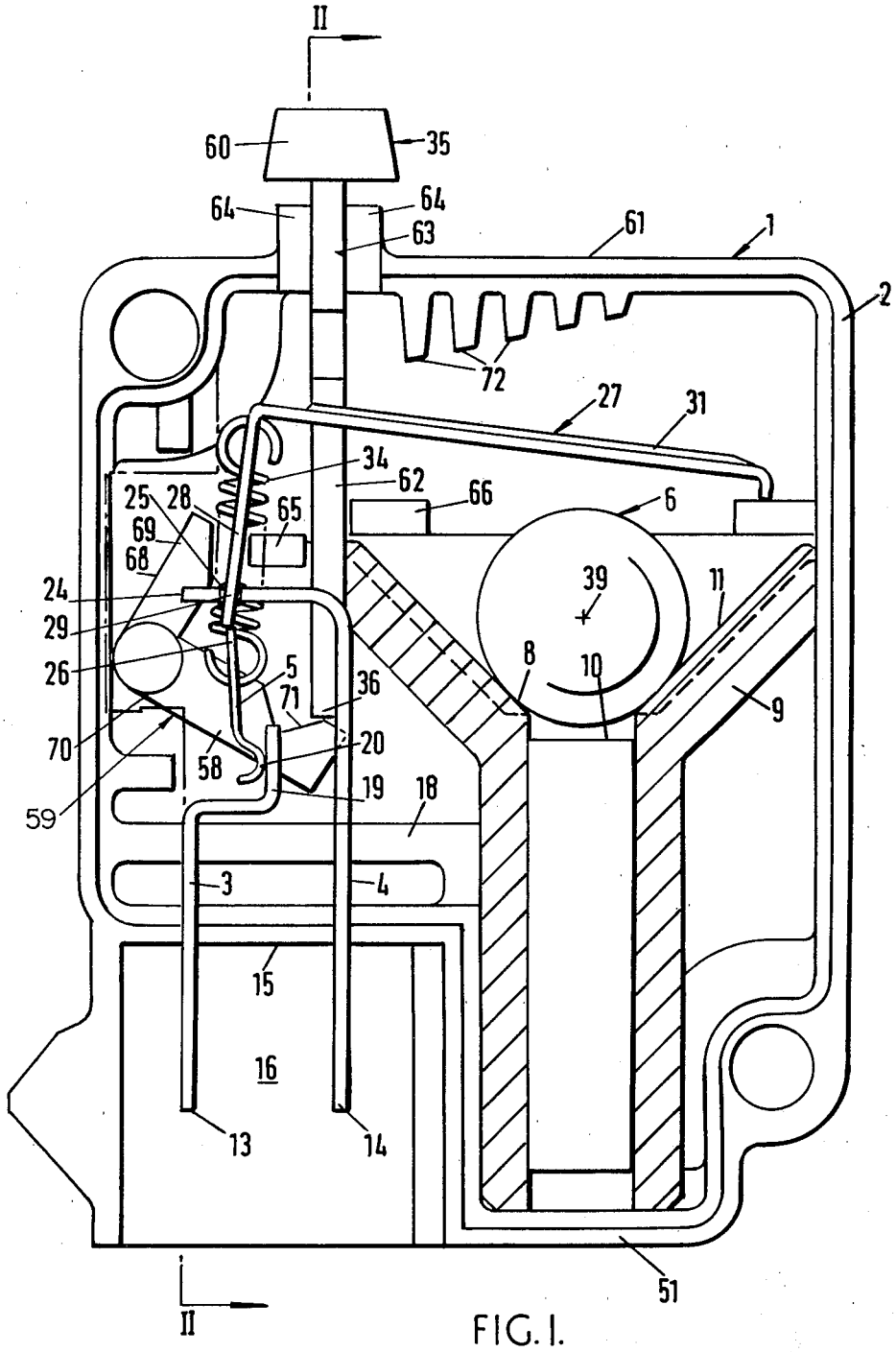
FIG. 1 is a longitudinal cross-sectional view of an inertia switch device in accordance with the invention.
Figure 2:
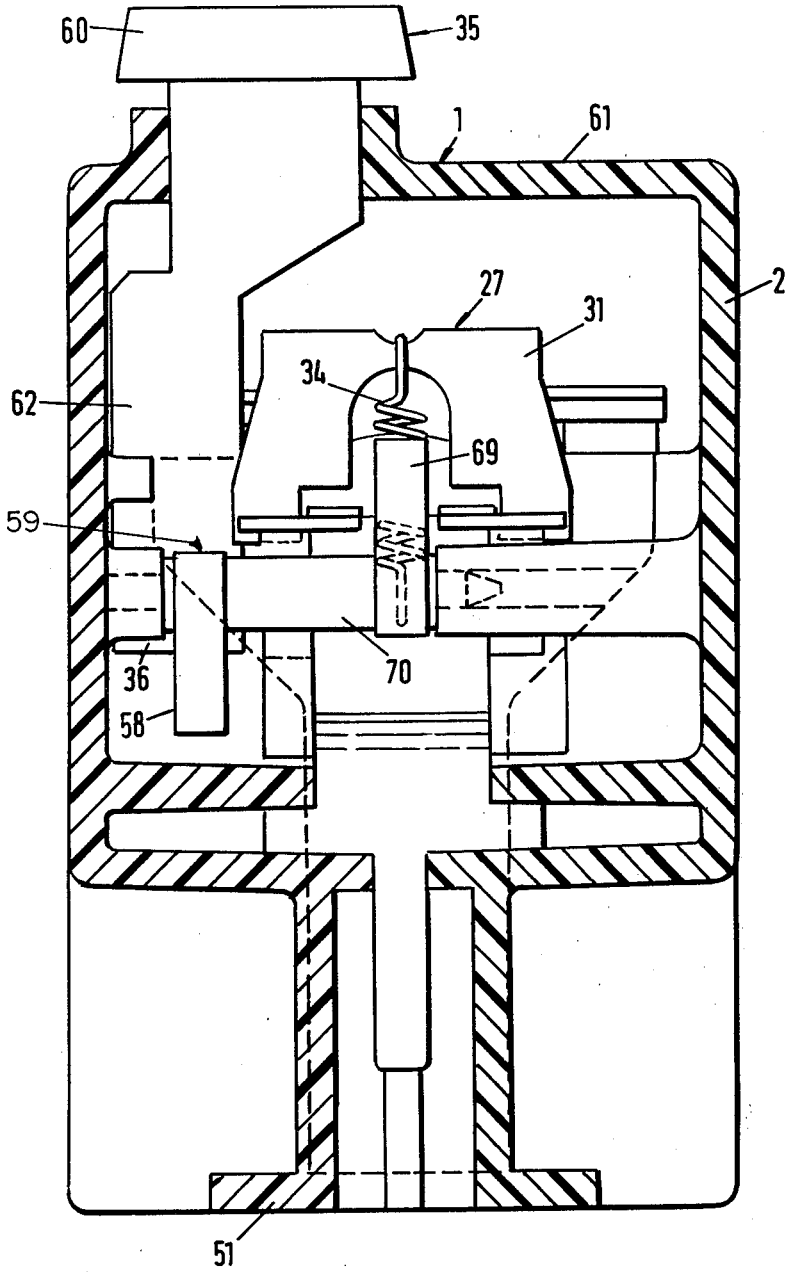
FIG. 2 is a cross-section on the line II—II in FIG. 1, looking in the direction of the arrows.
Figure 3:
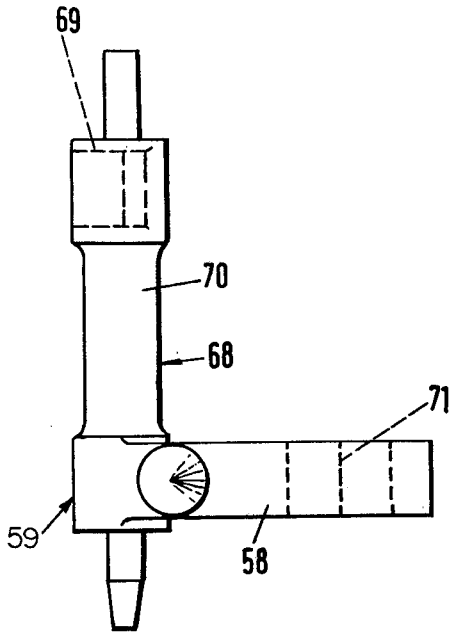
FIG. 3 is an under plan view of a cranked lever shown in end elevation in FIG. 1.
Figure 4:
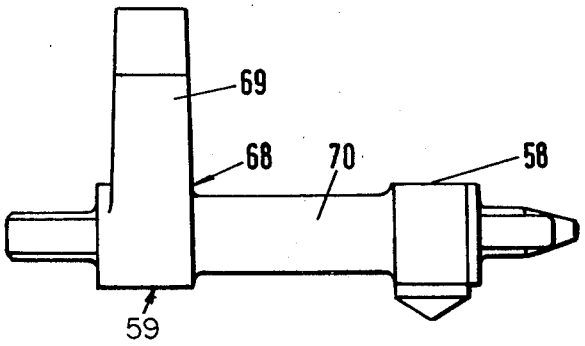
FIG. 4 is a side elevation of the cranked lever shown in FIG. 3.

Best Modes for Carrying out the Invention

Referring in the first instance to FIGS. 1 to 4, the inertia switch device 1 has a housing 2 of electrically insulating material in which are mounted two fixed electrical terminals 3 and 4 and a movable electrical contact member 5. The housing 2 also accommodates an inertia mass 6 responsive to acceleration or deceleration of the device 1 acting in a substantially horizontal direction when the device is mounted in the attitude illustrated in FIG. 1.

The inertia mass 6 comprises a spherical steel ball which normally rests on the bottom 8 of a frusto-conical seat 9 and is restrained in this position by a permanent magnet 10. The force exerted by the magnet 10 on the ball 6 is such that it is overcome by the attainment of the predetermined threshold value of acceleration or deceleration in a horizontal plane acting on the device 1 and thus on the ball 6. When this threshold value is attained the ball 6 moves away from the bottom 8 of the frusto-conical seat 9 and rides up the sloping side 11.

The electrical terminals 3 and 4 have respective lower portions 13 and 14 which lie parallel to one another and extend through a wall 15 into a recess 16 from which they are accessible from the outside of the housing 2 for the connection of electrical conductors thereto. The upper part of the electrical terminal 3, which extends through a wall 18, is cranked and has a vertically extending portion 19 which co-operates with a rounded portion 20 of the movable contact member 5. The upper part of the electrical terminal 4 also extends through the wall 18 and has a horizontally extending portion which terminates in a bifurcated end portion, each of the two limbs 24 of which has an indentation 25 in its upper surface.

The upper part of the movable contact member 5 is bifurcated the two limbs 26 forming the bifurcation bearing against respective indentations in the underside of the two limbs 24. A contact actuating member 27, which is generally L-shaped, has a bifurcated arm 28, the limbs 29 of which are seated for pivotal movement in the indentations 25 in the upper surface of the limbs 24 of the terminal 4. The other arm 31 of the actuating member 27 extends over the ball 6 and rests on the upper surface of the seat 9 in which the inertia mass 6 is accommodated. A helical tension spring 34, hooked at opposite ends into a hole in the contact actuating member 27 and a hole in the movable contact member 5, lies between the limbs of the bifurcations of these members 27, 4 and 5 and normally acts to urge the movable contact member 5 against the fixed terminal 3 and to urge the arm 31 of the actuating member 27 towards the ball 6.

A reset button 35 is slidably mounted in the housing 2 so that its lower end 36 engages a limb 58 of a linkage 59. The reset button 35 has a rectangular head 60 which projects from the upper wall 61 of the housing 2 and a stem 62 which extends into the interior of the housing 2 through a slot 63 formed between two upstanding shoulders 64 on the upper surface 61 of the housing 2. Abutments 65 and 66 formed on the wall of the housing act as guides for the stem 62 during sliding movement of the reset button 35.

The linkage 59 takes the form of a cranked lever 68 having two limbs 58 and 69 (see FIGS. 3 and 4) which extend substantially at right angles to each other and are located adjacent opposite ends of a shaft 70 which is pivotally mounted in the housing 2. The end of the limb 69 is arranged to engage the spring 34 and the end of limb 58 is provided with a notch 71 which is engaged by the lower end of the stem 62.

In use of the inertia switch device shown in FIG. 1 to 4, the device 1 is mounted on a vehicle with the base 51 of the housing 2 in a substantially horizontal plane with the rounded portion 20 of the moving contact member 5 engaging the portion 19 of of the electrical terminal 3. The arm 31 of the actuating member 27 extends over the ball 6 and rests on the upper surface of the seat 9 as seen in FIG. 1. The electrical terminals 3 and 4 are connected to electrical circuits (not shown) for electrically operated door locks of the vehicle or for an electrically operated supply valve in a fuel pump or a fuel supply pipe of the vehicle.

If there is an accident, such that an acceleration or deceleration in a horizontal plane in excess of a predetermined value is applied to the device 1, the inertia mass 6 will ride up the sloping side 11 of the frusto-conical seat 9 and strike the arm 31 of the actuating member 27. The arm 31 is moved upwards until it comes to rest against a series of ribs 72 on the underside of the upper wall 61 of the housing 2. This causes the spring 34 to move "over centre" so that the rounded portion 20 of the movable contact member 5 is moved away from the vertically extending portion 19 of the electrical terminal 3. Thus the electrical circuit for the electrically operated door locks or the electrically operated supply valve is broken, so that the door locks are released and the supply of fuel is cut off.

The spring 34 bears against the end of the limb 69 of the cranked lever 68 causing it to rotate in an anti-clockwise direction as seen in FIG. 1 so that the end of the limb 58 bears against the lower end 36 of the stem 62 and pushes the reset button 35 in an upward direction. The inertia switch device 1 remains in this condition until it is reset. The displacing of the reset button 35 in an upward direction provides a visual indication that the inertia mass 6 has struck the arm 31 of the actuating member 27.

The inertia switch device 1 is reset by depressing the reset button 35 which actuates the linkage 59 and returns the mechanism to its original position. Depressing rectangular head 60 towards the wall 61 of the housing 2 causes the lower end of the stem 62 to engage the notch 71 in the end of the limb 58 of the cranked lever 68 causing it to rotate in clockwise direction. The end of the limb 69 bears against the spring 34 and causes it to move "over centre" so that the rounded portion 20 of the movable contact member 5 engages the vertically extending portion 19 of the electrical terminal 3. The lower position of head 60 of the reset button indicates that the switch device 1 has been reset.

Figure 5:
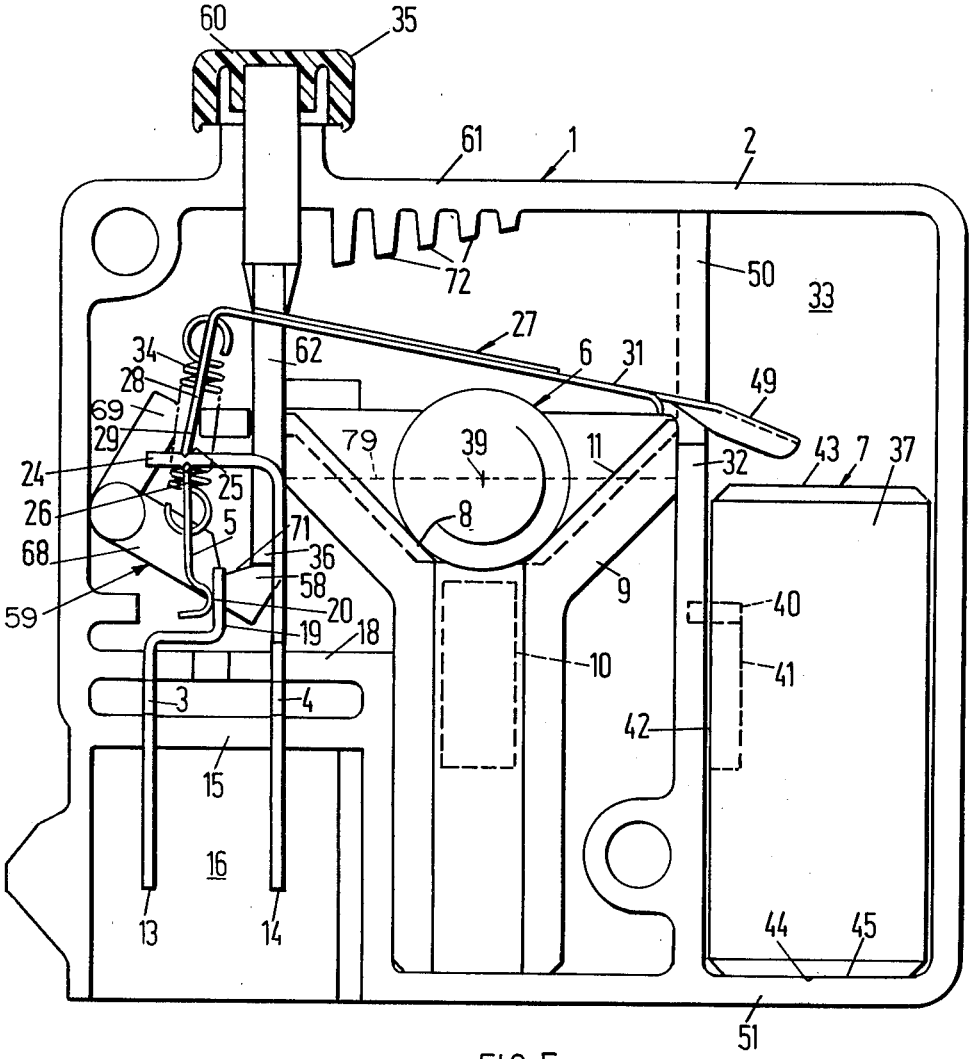
FIG. 5 is a longitudinal cross-sectional view of another inertia switch device in accordance with the invention having a second inertia mass.
Figure 6:
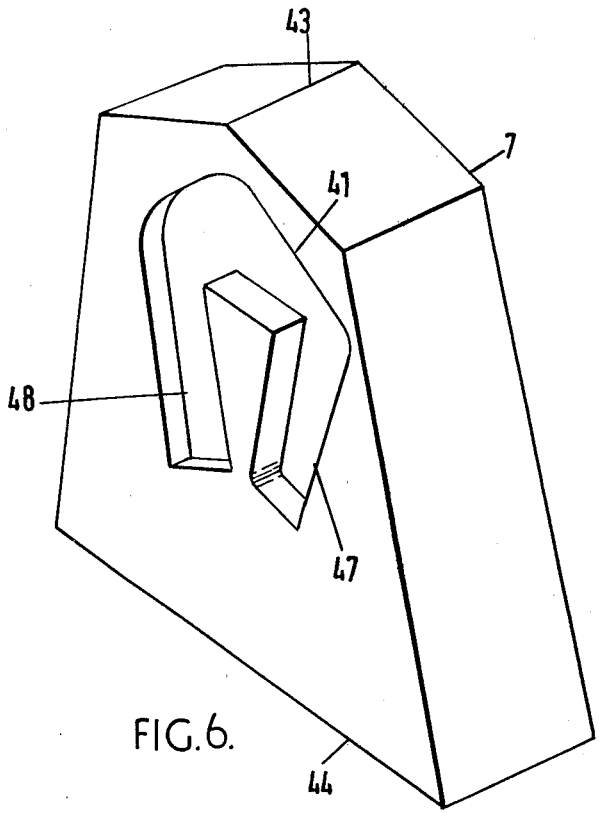
FIG. 6 is a perspective view of the second inertia mass shown in FIG. 5.
Figure 7:
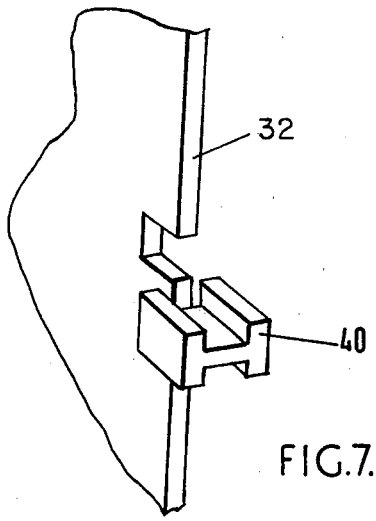
FIG. 7 is a fragmentary perspective view of a retaining peg shown in FIG. 5.

Turning now to FIGS. 5 to 7, the inertia switch device 1 is generally similar to that shown in FIGS. 1 to 4 but differs therefrom in that it includes a further inertia mass 7 responsive to angular rotation. The inertia mass 7 comprises a metal block 37 arranged to slide within the substantially rectangular compartment 33 within the housing 2 in response to angular rotation of device 1 about an axis 79. The extent and direction of the sliding movement of the metal block 37 is controlled by a peg 40 which lies within an inverted U-shaped slot 41 provided on side 42 of the metal block 37. The metal block 37 tapers towards its upper end 43 and its broader, lower end 44 normally rests on the bottom 45 of the compartment 33.

The peg 40, which is anchored in a wall 32 of the housing 2, normally projects into the slot 41 at a position at the apex of the inverted U and tends to keep the block 37 at or near to the bottom 45 of the compartment 33 when the device 1 is subjected to a force applied in a vertical direction such as is caused by a bump in a road along which a vehicle is travelling. When the metal block 37 is in this normal position the upper end 43 lies just below an end portion 49 of the arm 31 of the actuating member 27 which extends through a slot 50 in the wall 32.

In use of the inertia switch device shown in FIGS. 5 to 7, the device 1 is mounted on the vehicle with the base 51 of the housing 2 in a substantially horizontal plane and the axis 39 substantially parallel to the longitudinal axis of the vehicle. The electrical terminals 3 and 4 are connected to electrical circuits (not shown) for electrically operated door locks of the vehicle or for an electrically operated supply valve in fuel supply pipe of the vehicle.

If there is an accident, such that an acceleration or deceleration in a horizontal plane in excess of a predetermined value is applied to the device 1, the inertia mass 6 will ride up the sloping side 11 of the frusto-conical seat 9 and strike the arm 31 of the actuating member 27. The arm 31 is moved upwards until it comes to rest against a series of ribs 72 on the underside of the upper wall 61 of housing 2. This causes the spring 34 to move "over centre" so that the rounded portion 20 of the movable contact member 5 is moved away from the vertically extending portion 19 of the electrical terminal 3. Thus the electrical circuit for the electrically operated door locks or the electrically operated supply valve is broken, so that the door locks are released and the supply of fuel is cut off.

The spring 34 bears against the end of the limb 69 of the cranked lever 68 causing it to rotate in an anti-clockwise direction as seen in FIG. 5 so that the end of the limb 58 bears against the lower end 36 of the stem 62 and pushes the reset button 35 in an upward direction. The inertia switch device 1 remains in this condition until it is reset. The displacing of the reset button 35 in an upward direction provides a visual indication that the inertia mass 6 has struck the arm 31 of the actuating member 27.

If the accident is such that the acceleration or deceleration is not in excess of the predetermined value, but the vehicle rolls about its longitudinal axis through an angle in excess of 90 degrees, the device 1 will rotate around the inertia mass 7 which tends to remain in its original rest position in space. The compartment 33 therefore slides around relative to the inertia mass 7, the slot 41 moving around relative to the peg 40 so that the peg 40 eventually occupies a position along one of the arms 47 or 48 depending on the extent and the direction of the angular rotation of the vehicle. The upper end 43 of the inertia mass 7 will therefore strike end portion 49 of the arm 31 of the actuating member 27. The movable contact member 5 is therefore moved away from the vertically extending portion 19 of the electrical terminal 3 to break the electrical circuit for the electrically operated door locks or the electrically operated fuel supply valve.

The device 1 can be reset when the vehicle has been returned to its original, upright position by depressing the reset button 35 which actuates the linkage 59 and returns the mechanism to its original position. Depressing rectangular head 60 towards the wall 61 of the housing 2 causes the lower end of the stem 62 to engage the notch 71 in the end of the limb 58 of the cranked lever 68 causing it to rotate in clockwise direction. The end of the limb 69 bears against the spring 34 and causes it to move "over centre" so that the rounded portion 20 of the movable contact member 5 engages the vertically extending portion 19 of the electrical terminal 3. The lower position of the head 60 of the reset button indicates that the switch device 1 has been reset. While the embodiment of the invention shown in FIGS. 5 to 7 has the slot 41 in the block 37 and the peg 40 anchored in a wall 32 of the housing 2 it will be appreciated that in other embodiments of the invention the peg 40 may be secured to the block 37 and the slot 41 provided in the wall 32 of the housing.

Figure 8:
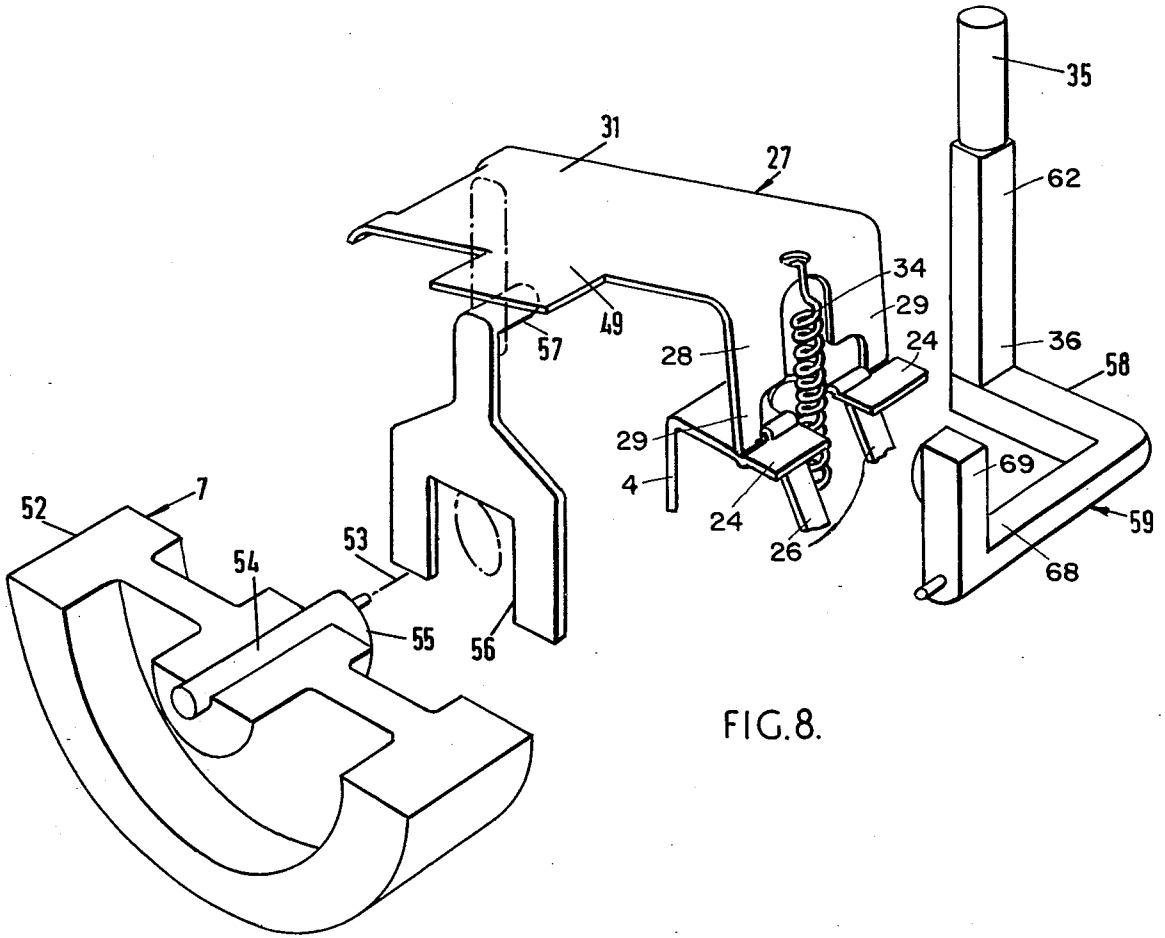
FIG. 8 is a fragmentary perspective view of an alternative form of the second inertia mass shown in FIG. 5.

Turning finally to FIG. 8 in which the same reference numerals are used for parts similar to those shown in FIGS. 1 and 5. The alternative form of the inertia mass 7 comprises a substantially hemi-cylindrical block 52 which is pivotally mounted for rotation about an axis 53. The block 52 forming the inertia mass 7 is accommodated and pivotally mounted in a compartment of the inertia device 1 similar to the compartment 33 shown in FIG. 5 but located on the side of the housing 2. A shaft 54, which is rotationally fast with the block 52 and which provides the pivotal mounting, carries a cam 55 at one end which is arranged to co-operate with a cam follower 56 slidably mounted in the compartment. An abutment 57 on the upper end of the cam follower 56 is arranged to engage the end portion 49 of the arm 31 of the actuating member 27. When the device 1 is subjected to a force applied in a vertical direction such as is caused by a bump in a road along which the vehicle is travelling, the pivotal mounting resists vertical movement so that the block 52 tends to remain in its original position in space.

In the event of an accident such that vehicle rolls about its longitudinal axis through an angle in excess of 90 degrees, the device 1 will rotate around the hemi-cylindrical block 52 forming the inertia mass 7 which tends to remain in its original rest position in space. The cam follower 56 therefore rotates around the cam 55 so that the abutment 57 is urged into engagement with the end portion 49 of the arm 31 of the actuating member 27. The movable contact member 5 is therefore moved away from the vertically extending portion 19 of the electrical terminal 3 to break the electrical circuit for the electrically operated door locks or the electrically operated fuel supply valve. As before the device can be reset by depressing the reset button 35 so that the lower end 36 of the stem 62 engages the limb 58 of the cranked lever 68 forming the linkage 59, causing the other limb 69 to bear against the spring 34 intermediate its end and move it over centre.

While in the embodiments of the invention described above the rounded portion 20 of the moving contact member 5 and the portion 19 of the electrical terminal 3 form "normally closed" contacts, other embodiments of the invention may utilize "normally open" contacts or "changeover" contacts.

We claim:

1. An inertia switch device comprising:

(a) an inertia mass which is movable from a rest position when the device is subjected to an applied acceleration or deceleration in a horizontal plane;

(b) means for retaining the inertia mass in the rest position until the applied acceleration or deceleration in a horizontal plane exceeds a threshold value;

(c) a first electrical contact movable between a first stable position in which it engages a second electrical contact and a second stable position in which it no longer engages the second electrical contact;

(d) support means having a bifurcated portion on which is pivotally mounted a bifurcated portion of the first electrical contact;

(e) operating means engageable by the inertia mass on movement of the inertia mass as a result of the applied acceleration or deceleration exceeding the threshold value, to move the first electrical contact from the first to the second stable position, or vice versa;

(f) the operating means comprising a first limb which is struck by the inertia mass when the threshold value is exceeded and a second limb having bifurcated portion which is pivotally mounted on the support means but on the opposite side to the first electrical contact;

(g) resilient biassing means which lies within the bifurcated portions and extends between the first electrical contact and the second limb and can be moved over center so as to bias the first electrical contact towards the first or second stable position depending on the position of the second limb; and (h) resetting means comprising an operating member arranged to actuate a linkage which engages the resilient biassing means intermediate its ends to push the resilient biassing means over center and thereby return the first electrical contact to its original stable position.

2. An inertia switch device as claimed in claim 1, wherein the linkage comprises a cranked lever which is engaged by the operating member and which engages the resilient biassing means when actuated by the operating member.

3. An inertia switch device as claimed in claim 2, wherein the cranked lever has two limbs which extend substantially at right angles to each other and are located at opposite ends of a pivotally mounted shaft.

4. An inertia switch device as claimed in claim 2, wherein the cranked lever has a limb provided with a notch which is engaged by a stem of the operating member.

5. An inertia switch device as claimed in claim 1, wherein the resilient biassing means comprises a helical tension spring hooked at opposite ends into respective holes in the first electrical contact and the second limb of the operating means.

6. An inertia switch device as claimed in claim 1, having a housing which accommodates the inertia mass, the electrical contacts, the operating means and the resilient biassing means and wherein the operating member extends out of the housing by an amount which provides a visual indication as to whether the operating means have been struck by the inertia mass.

7. An inertia switch device as claimed in claim 6, wherein the electrical contacts are respectively connected to two electrical terminals accessible from the exterior of the housing.

8. An inertia switch as claimed in claim 6, wherein the operating member is slidably mounted in the housing and extends through an upper wall of the housing.

9. An inertia switch device as claimed in claim 1, wherein the operating means is engageable by a second inertia mass which is arranged to maintain an initial rest position when the device is subjected to an applied angular rotation about an axis substantially parallel to said horizontal plane and which is also arranged to operate the electrical contacts when the applied angular rotation exceeds a predetermined value.

10. An inertia switch device as claimed in claim 9, wherein the second inertia mass is slidably mounted to produce operation of the electrical contacts when the device is subjected to said applied angular rotation.

11. An inertia switch device as claimed in claim 9, wherein the second inertia mass comprises a block slidably mounted within a compartment and arranged to resist operation of the electrical contacts by a force applied in a direction normal to the horizontal plane by a peg on the block engaging in a slot provided in the compartment.

12. An inertia switch device as claimed in claim 11, wherein the slot has an inverted U-shape, and the peg is arranged to engage the slot at a position at the apex of the inverted U-shape and to move along one of the arms of the slot depending on the direction of angular rotation of the device.

13. An inertia switch device as claimed in claim 9, wherein the second inertia mass is pivotally mounted to produce operation of the electrical contacts when the device is subjected to said applied angular rotation.

14. An inertia switch device as claimed in claim 9, wherein the second inertia mass comprises a block pivotally mounted so as to resist operation of the electrical contacts by a force applied in a direction normal to the horizontal plane.

15. An inertia switch device as claimed in claim 14, wherein the pivotally mounted block is hemi-cylindrical.

16. An inertia switch device as claimed in claim 14, wherein the operation of the electrical contacts is produced by a cam follower arranged to co-operate with a cam rotationally fast with the pivotally mounted block.

17. An inertia switch device as claimed in claim 9, wherein the electrical contacts are arranged to be operated when the applied angular rotation exceeds 90 degrees.

* * * * *